US009129758B2

(12) United States Patent
Chen

(10) Patent No.: US 9,129,758 B2
(45) Date of Patent: Sep. 8, 2015

(54) ROCKER SWITCH DEVICE

(75) Inventor: Chien Hua Chen, Taipei (TW)

(73) Assignee: BOARD-TECH ELECTRONIC CO., LTD, New Taipei (TW)

( * ) Notice: Subject to any disclaimer, the term of this patent is extended or adjusted under 35 U.S.C. 154(b) by 49 days.

(21) Appl. No.: 13/451,647

(22) Filed: Apr. 20, 2012

(65) Prior Publication Data

US 2013/0092518 A1 Apr. 18, 2013

(30) Foreign Application Priority Data

Oct. 17, 2011 (TW) ..... 100137487 A

(51) Int. Cl.

| | |
|---|---|
| ***H01H 1/22*** | (2006.01) |
| ***H01H 1/12*** | (2006.01) |
| ***H01H 9/30*** | (2006.01) |
| ***H01H 23/20*** | (2006.01) |
| *H01H 23/08* | (2006.01) |

(52) U.S. Cl.

CPC . *H01H 1/12* (2013.01); *H01H 9/30* (2013.01); *H01H 23/205* (2013.01); *H01H 23/08* (2013.01)

(58) Field of Classification Search

USPC ..... 200/502, 6 R, 4, 448, 244, 437, 553

See application file for complete search history.

(56) References Cited

U.S. PATENT DOCUMENTS 5,735,392 A * 4/1998 Shirasaka ..... 200/553
6,570,114 B1 * 5/2003 Czarnecki ..... 200/553

* cited by examiner

*Primary Examiner* — Vanessa Girardi

(74) *Attorney, Agent, or Firm* — Amin, Turocy & Watson, LLP

(57) ABSTRACT

Disclosed is a switch device including a housing, a plurality of components (including a conductive member, a conducting member, a switch member and an actuating member) accommodated in the housing, and a lid body disposed on the housing. Two vertical boards are disposed on a bottom portion of the housing, and a receiving space is formed in a middle part of the bottom portion. The conductive member has an electrode that is disposed on an upper side in the receiving space adjacent to the two vertical boards. A plurality of grooves are disposed on the bottom portion outside the two vertical boards. The switch member is disposed in the receiving space. A contact pad corresponding to the electrode is disposed between a bottom portion of the switch member and the actuating member at a top portion of the switch member, and is linearly aligned with the actuating member.

10 Claims, 5 Drawing Sheets

ROCKER SWITCH DEVICE

BACKGROUND OF THE INVENTION

1. Field of the Invention

The present invention relates to switch devices, and, more particularly, to a rocker switch device designed to prevent fire disasters and incidents from occurrence.

2. Description of Related Art

It has been long since known that a great many of fire incidents and disasters are initiated and ignited by short circuits of electrical wires that were not properly fused or due to the defective switch designs. Many of the switch devices presently available in the market merely address issues of negative overloads with the solution of electric breakdown systems, while at the same time a crucial factor of electric arcs which are usually covered by a lid body seem to be overlooked. The so-called arc factor refers to the generation of an electric arc when a switch device is turned on. More often than not, there is a surprising amount of dust accumulated in the switch device and they include dirt or dust particles that are generated from electric arcs, and over time the accumulated dust may generate heat since such dirt or dust particles are considered risk conductors, thereby leading to dust explosion or even combustion of fire due to overheating of the accumulated dust, which then causes electric arcs to ignite along the electric wire and a short circuit as a result.

As shown in FIGS. 1 and 1*a*, a conventional switch device 1 has a housing 10 in which a first conductive member 11, a second conductive member 12, a conducting member 13, a switch member 14, an actuating member 15, and a lid body 16 to be covered thereon are accommodated.

The foregoing housing 10 is formed with a bottom portion 10*a* and an opening 100, the bottom portion 10*a* having a vertical board 101 formed thereon for allowing a receiving space S to be formed between the vertical board 101 and the inner wall 10*b* of the housing 10, and the lower side of the vertical board 101 and the inner wall 10*b* respectively have a V-shaped groove 102 formed thereon, whereas the upper side of the inner wall 10*b* has a plurality of linear grooves for collecting accumulative dust.

The aforementioned first conductive member 11 is disposed in the housing 10 and comprises a first electrode 110 extending to the receiving space S and adjacent to a left side of the inner wall 10*b*. The second conductive member 12 is disposed in the housing 10 and comprises a second electrode 120 extending to the receiving space S and adjacent to a right side of the inner wall 10*b*. The conducting member 13 is disposed in the housing 10 extending to the bottom portion 10*a* of the receiving space S.

The switch member 14 is in a slice shape swingingly disposed in the receiving space S by the restriction of a V-shaped groove 102, and further has a bottom end 14*a* and a top end 14*b* formed thereon, the bottom end 14*a* of the switch member 14 being in contact with the conducting member 13, the top end 14*b* thereof having a motion portion 140 disposed at a position close to the vertical board 101 and the inner wall 10*b* to correspond to first and second contact pads 141, 142 of the first and second electrodes 110, 120.

The upper side of the driving member 15 is penetratingly disposed on the lid body 16 to externally connect with a press button 150, whereas the lower side thereof is connected to a spring 151 of the motion portion 140 to relatively drive the switch member 14 to swing to and fro. The lid body 16 is disposed on the opening 100 of the housing 10.

Referring together to FIGS. 1*b* and 1*c*, when in motion, pressure is exerted onto the press button 150 to push the spring 151 to move towards a predetermined direction and thus relatively drive the switch member 14 that is supported by its bottom end 14*a* as a pivot for allowing its top end 14*b* to swing towards one direction, as depicted in a left side of FIG. 1*b*, thereby enabling the first contact pad 141 to be in contact with the first electrode 110, whereas when swinging towards a right side, the second contact pad 142 is enabled to contact with the second electrode 120.

The spring 151 is disposed to connect with the motion portion 140, whereas the spring 151, the motion portion 140, and the first and second contact pads 141, 142 are in an L-shaped alignment, as shown in an imaginary line of FIG. 1. Therefore, the pressured point P is situated at a side of the switch member 14 rather than a central portion thereof, making the switch member 14 prone to displacement and deviation in swinging as shown in FIG. 1*c*, thus causing either first or second contact pads 141, 142 to fail to be in full contact with the first or second electrodes 110, 120, as shown in an interval t in FIG. 1*c*, which causes significant leakage of electric arcs in the first or second contact pads 141, 142 and generates massive sparks that ignite the accumulated tiny dust to combustion and eventually lead to short circuits as a result.

Furthermore, in the conventional switch device 1, the upper side of the inner wall 10 has a linear groove 103 for collecting accumulative dust. However, the design of the linear groove 103 has been proved to be defective because the more dust accumulated over time, the closer the distance gets between the accumulated dust and the first or second contact pads 141, 142. Therefore, when electric arcs are generated due to electric leakage, the accumulated dust becomes more combustible and thus easily causes fire disasters.

Therefore, it is desirable and highly beneficial to propose a more effective and ideal design of switch devices that can overcome the drawbacks as encountered in prior techniques.

SUMMARY OF THE INVENTION

In view of the drawbacks associated with the prior techniques, a primary objective of the invention is to provide a switch device comprising a housing formed with a bottom portion and an opening, the bottom potion of the housing having two vertical boards disposed thereon to form a receiving space in the middle part thereof, wherein a plurality of grooves are formed on the bottom portion on the periphery of the vertical boards for allowing an electrode of the conductive member to be posited on an upper side adjacent to the two vertical boards in the receiving space; a plurality of components accommodated in the housing (including a conductive member, a guiding member, a switch member and an actuating member), and a lid body disposed on the housing. The switch member may be swingingly disposed in the receiving space and has opposing first and second ends, the first end being in contact with a conducting member disposed on the bottom of the receiving space, the second end having a motion portion connected to the actuating member, wherein a contact pad corresponding to the conductive member is disposed between the first end and the motion portion. In the switch device of the present invention, the contact pad may be disposed right beneath the motion portion to be in a linear alignment, and the actuating member may comprise a press button disposed penetratingly through and exposed from the lid body, and an elastic body connected to the motion portion. The switch member has a contact pad corresponding to the electrode formed thereon for allowing the actuating member and the contact pad to be linearly aligned, thereby preventing the switch device from displacement while allowing a full contact between the contact pad and the electrode, which significantly reduce the amount of electric arcs and thus avoid generating excessive sparks.

Further, the housing has a plurality grooves formed thereon for collecting dust accumulated over time, and also there is a certain distance existing between the accumulated dust and the contact pad that can prevent electric arcs from igniting the accumulated dust to combustion and thus resulting in short circuits.

BRIEF DESCRIPTION OF THE DRAWINGS

The present invention can be more fully understood by reading the following detailed description of the preferred embodiments, with reference made to the accompanying drawings, wherein:

FIG. 1 is a three-dimensional exploded view of a conventional switch device; wherein FIG. 2 a three-dimensional exploded view of the switch device of the present invention, wherein

DETAILED DESCRIPTION OF THE PREFERRED EMBODIMENTS

The following illustrative embodiments are provided to illustrate the disclosure of the present invention, these and other advantages and effects can be understood by persons skilled in the art after reading the disclosure of this specification. Note that the structures, proportions, sizes depicted in the accompanying figures merely illustrate the disclosure of the specification to allow for comprehensive reading without a limitation to the implementation or applications of the present invention, and does not constitute any substantial technical meaning. Also, the expressions and terms quoted in the specification including "upper," "lower," "top," "bottom," "front," "rear," "left," "right," "four," and "one" are illustrative but not restrictive, and may encompass alterations or adjustments of its relative relations without substantially altering the technical contents contained therein.

Figure 1:
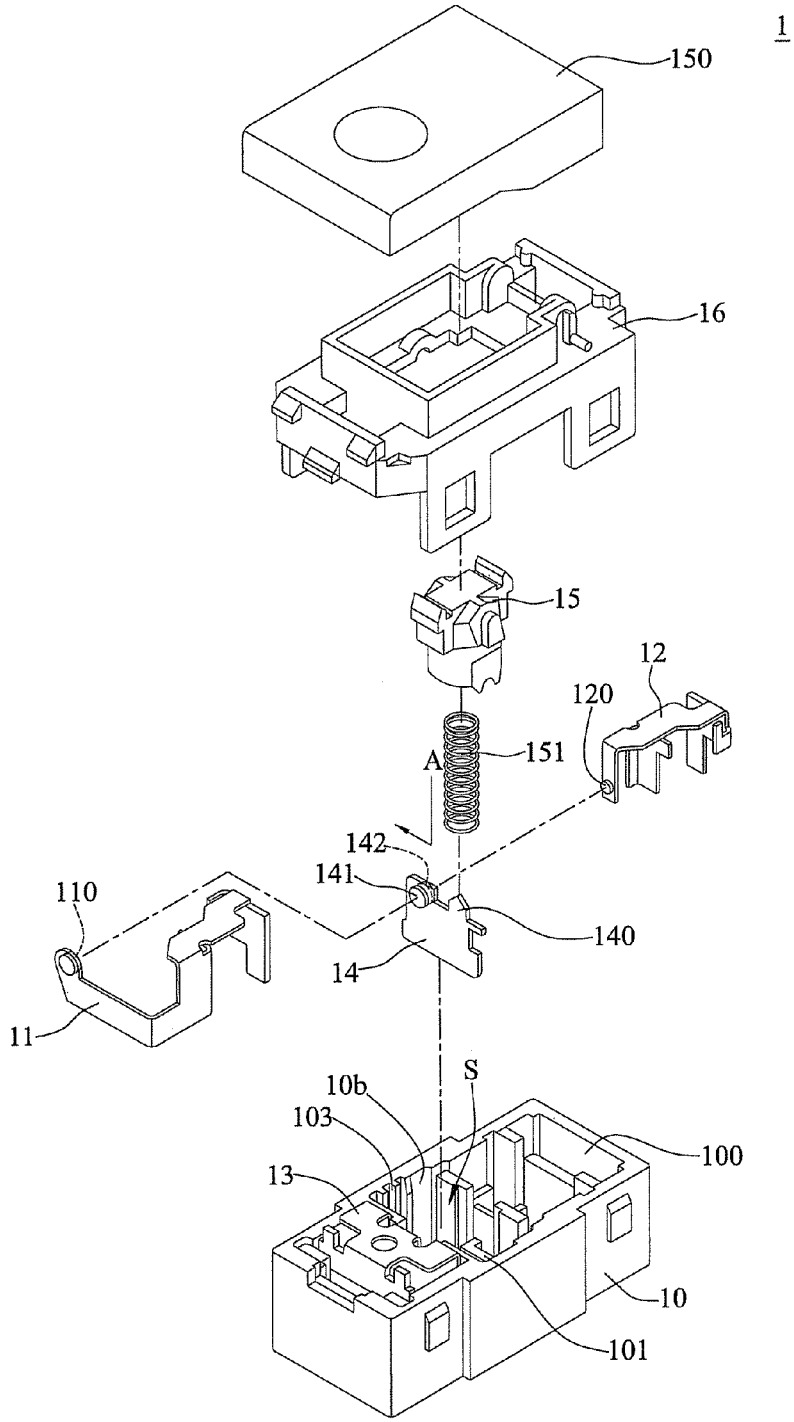
FIG. 1 (PRIOR ART)
Figure 1A:
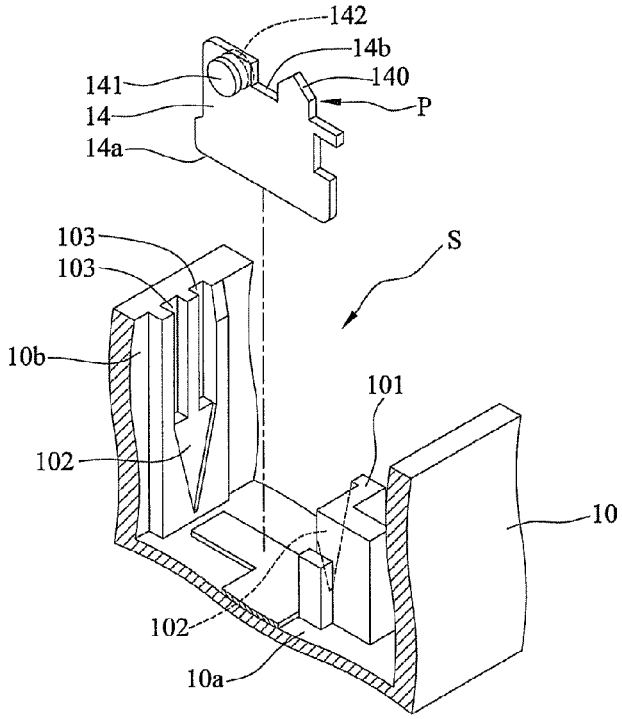
FIG. 1a (PRIOR ART)
FIG. 1*a* depicts a partial 3D view of FIG. 1, FIGS. 1*b* and 1*c* represent a partial top view of FIG. 1 when in motion.
Figure 1B:
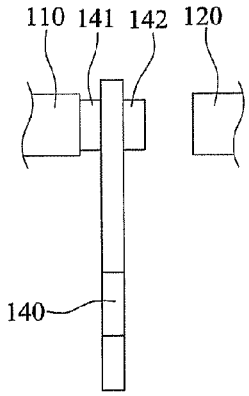
FIG. 1b (PRIOR ART)
Figure 1C:
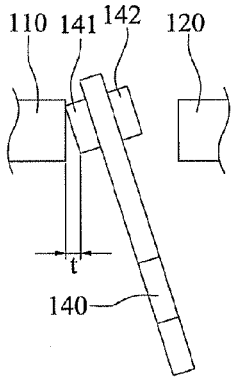
FIG. 1c (PRIOR ART)
Figure 2:
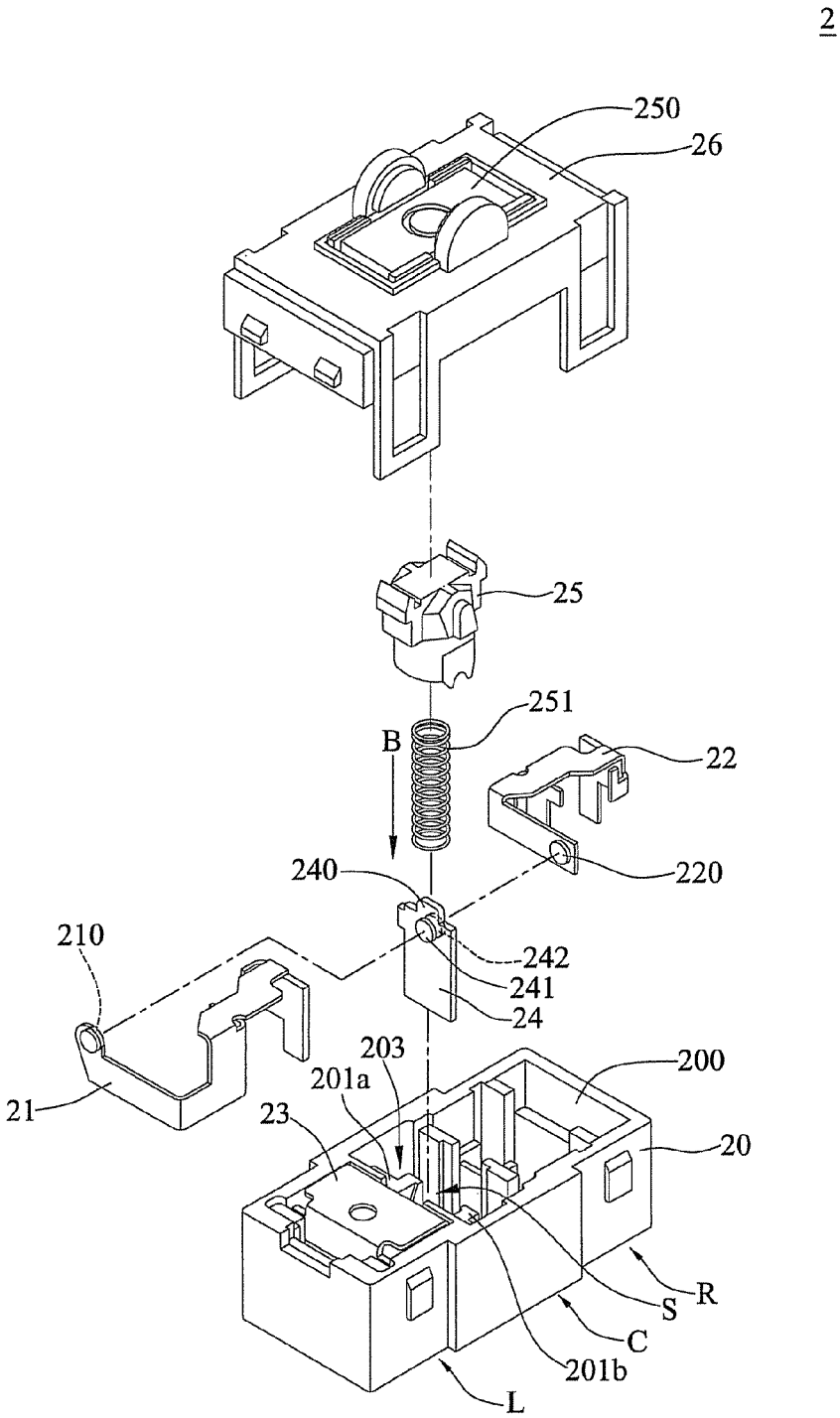
Figure 2A:
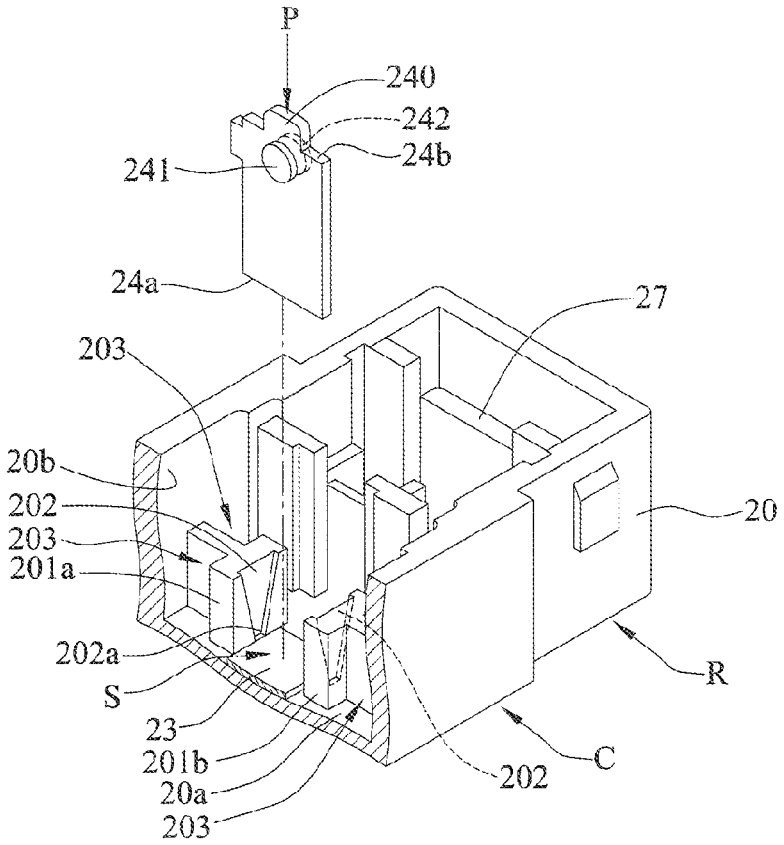
FIG. 2*a* depicts a partial 3D view of FIG. 2.

FIGS. 2 and 2*a* illustrate a switch device 2 according to the present invention, which may be a press button switch comprised of a housing 20, a plurality of components accommodated in the housing 20 including a first conductive member 21, a second conductive member 22, a conducting member 23, a switch member 24, a driving member 25, and a lid body 26 to be covered thereon.

The foregoing housing 20 is formed with a bottom portion 20*a* and an opening 200, thereby dividing the housing 20 into a left portion L, a central portion C and a right portion R. The bottom portion 20*a* located in the middle of the central portion C has two vertical boards 201*a*, 201*b* formed thereon to form a receiving space S, and the front and rear portions in the central portion C of the bottom portion 20*a* have four grooves 203 formed thereon each one having an appropriate depth at positions adjacent to the vertical boards 201*a*, 201*b*.

In this embodiment, the receiving space S is interconnected to the left portion L but not the right portion R, and each of the vertical boards 201*a*, 201*b* has a groove 202 formed thereon which is formed gradually shrinking towards its bottom surface in a similar V shape, wherein a rectification space 202*a* is formed on the bottom side of the groove 202.

The aforementioned first conductive member 21 is disposed at the front side of the right portion R in the housing 20, and comprises a first electrode on a left side of the inner wall 20*b* extending to the receiving space S and adjacent to the vertical boards. The second conductive member 22 is disposed at the rear side of the right portion R in the housing 20, and comprises a second electrode formed on a right side of the inner wall 20*b* extending to the receiving space S and adjacent to the vertical boards. The conducting member 23 is disposed at the left portion L in the housing 20 and extends to the bottom portion 20*a* of the receiving space S.

The switch member 24 is slice-shaped and can be swingingly disposed in the receiving space S by means of restraint of the V-shaped groove 202. Also, the switch member 24 has a first end 24*a* (i.e., the bottom end as shown in the figure) and a second end 24*b* (i.e., the top end as illustrated) opposite to each other formed thereon, the first end 24*a* being in contact with the conducting member to serve as a nonstationary floating pivot, the second end 24*b* having a motion portion 240, and first and second contact pads 241, 242 formed on its left and right sides respectively at positions under the motion portion 240 for corresponding to first and second electrodes 210, 220.

In this embodiment, the switch member 24 is swingingly disposed in the receiving space S and restricted by the V-shaped groove 202, and the swinging is automatically corrected by the rectification space 202*a*. The motion portion 240 is a protrusion base for coupling and embedding the spring therein, the first and second contact pads 241, 242 are disposed at positions right beneath the motion portion 240 to thereby form a linear alignment. (i.e., an imaginary line B depicted in the figure).

The driving member 25 is connected to the motion portion 240 to cause the switch member 24 to swing back and forth. In this embodiment, the upper side of the driving member 25 is penetratingly disposed on the lid body 26 for externally connecting to a press button 250, whereas the lower side thereof is connected to a spring 251 of the motion portion 240, wherein the spring 251 may be a coil spring for enabling the motion portion 240 to be embedded into the opening of the spring. The lid body 26 is disposed on the opening 200 of the housing 20.

Figure 2B:
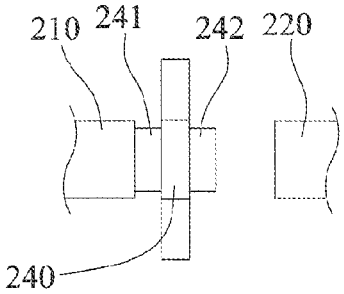
FIG. 2*b* represents a partial top view of FIG. 1.
Figure 2C:
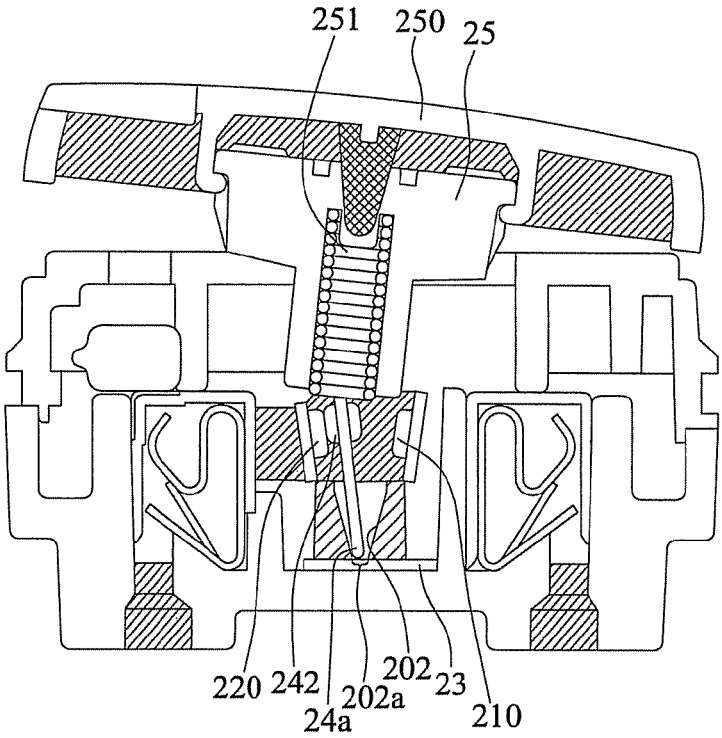
FIG. 2*c* is a rear cross-sectional view of FIG. 2 when in motion.

When in motion, referring together to FIGS. 2*b* and 2*c*, pressure is exerted onto the right end of the press button 250 for the spring 251 to move towards a predetermined left direction to thereby relatively drive the switch member 24 which is supported by its first end 24*a* serving as a pivot, to swing towards a left direction for allowing the first contact pad 241 to be in contact with the first electrode 210, whereas when swinging towards a right side, the second contact pad 242 is enabled to come into contact with the second electrode 220.

The invention is characterized by disposing first and second contact pads 241, 242 in between the first end 24*a* and the motion portion 240 to form a linear alignment, therefore, the pressured point P of the switch member 24 lies on an upper side (or a middle side) of the first and second contact pads 241, 242 to thereby prevent swinging from deviation, and also the rectification space 202*a* of the groove 202 is adapted to automatically rectify the position of the first end 24*a* of the switch member (as shown in FIG. 2*c*) to facilitate the full contact of electrodes 210, 220 (as shown in FIG. 2*b*) to effectively reduce the amount of electric arcs and avoid generation of excessive sparks.

Furthermore, in case of dust accumulating in the housing 20, the design of grooves 203 is effective in collecting dust accumulated over time, and there exists a certain distance (i.e., divided by the vertical board 201) and the grooves 203 are formed with a sufficient depth for accommodating the accumulated dust therein to prevent spontaneous random combustion by electric sparks that cause fire disasters due to accidents of short circuits.

In addition, the switch device 2 of the invention is capable of passing high standard testing, such as the US standard (UL Certification). In the US standard testing, for example, a voltage 277V with a 72 ampere current would include testing items of 100 times of switching operations, 30,000 times of different power full load switch testing, temperature-raising testing, and also before and after the testing the high pressure cannot be lower than 1500V. Due to the complex of existing testing items, the details thereof will not be further described herein for brevity.

Furthermore, the housing 20 of the switch device 2 may comprise multiple dividing boards 27, as shown in FIG. 2*a*, to block up electric arcs and reduce leakage of excessive sparks that may otherwise ignite the accumulated dust into combustion as a result.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A switch device, comprising a housing formed with a bottom portion, an opening opposing the bottom portion, two vertical boards disposed on the bottom portion, a receiving space formed between the vertical boards and in a middle part of the bottom portion, and a plurality of grooves formed on the bottom portion outside the vertical boards, wherein the two vertical boards have one or more additional grooves formed thereon, the additional grooves shrinking toward the bottom portion gradually and having a rectification space formed on a bottom side thereof;

a first conductive member disposed in the housing and comprising a first electrode disposed above a side of the receiving space and being free from disposing in the plurality of grooves, wherein the side is adjacent to the two vertical boards;

a conducting member disposed on a bottom portion of the receiving space;

a flat-plate switch member swingingly disposed in the receiving space, and having a first end in contact with the conducting member to serve as a nonstationary floating pivot, a second end opposing the first end and having a motion portion, and a first contact pad disposed between the first end and the motion portion and corresponding to the first electrode, wherein the additional grooves restrict a swinging of the switch member;

a driving member connected to the motion portion and driving the switch member to swing back and forth; and a lid body disposed on the opening of the housing.

2. The switch device claimed in claim 1, wherein the flat-plate switch member is driven to swing to enable the first contact pad to come into contact with or be detached from the first electrode.

3. The switch device claimed in claim 1, wherein the first end of the flat-plate switch member serves as a pivot, for the driving member to drive the motion portion to swing back and forth.

4. The switch device claimed in claim 1, wherein the first contact pad is disposed right beneath the motion portion and in a linear alignment with the motion portion.

5. The switch device claimed in claim 1, wherein the first end of the flat-plate switch member serves as a nonstationary floating pivot.

6. The switch device claimed in claim 1, wherein the driving member has a press button penetrating the lid body and exposed from the lid body, and an elastic body connected to the motion portion.

7. The switch device claimed in claim 6, wherein the elastic body is a spring.

8. The switch device claimed in claim 1, further comprising a second conductive member disposed in the housing, and having a second electrode formed above an opposite side of the receiving space, wherein the opposite side is adjacent to the two vertical boards.

9. The switch device claimed in claim 8, further comprising a second contact pad disposed between the first end and the motion portion and corresponding to the second electrode.

10. The switch device claimed in claim 9, wherein the second contact pad is disposed right beneath the motion portion and in a linear alignment with the motion portion.

* * * * *